United States Patent [19]

Ibrahim

[11] Patent Number: 4,457,139

[45] Date of Patent: Jul. 3, 1984

[54] REFRIGERATED DISPLAY CASE HAVING AMBIENT AIR DEFROST

[75] Inventor: Fayez F. Ibrahim, Niles, Mich.

[73] Assignee: Tyler Refrigeration Corporation, Niles, Mich.

[21] Appl. No.: 361,798

[22] Filed: Mar. 25, 1982

Related U.S. Application Data

[63] Continuation-in-part of Ser. No. 117,571, Feb. 1, 1980, which is a continuation-in-part of Ser. No. 60,459, Jul. 25, 1979, Pat. No. 4,295,340, which is a continuation-in-part of Ser. No. 11,804, Feb. 14, 1979, abandoned, and a continuation-in-part of Ser. No. 295,542, Aug. 24, 1981.

[51] Int. Cl.[3] ..... A47F 3/04

[52] U.S. Cl. ..... 62/256; 98/108

[58] Field of Search ..... 62/256, 255, 277, 82, 62/282; 98/103, 108

[56] References Cited

U.S. PATENT DOCUMENTS

| | | | |
|---|---|---|---|
| 3,226,945 | 1/1966 | Spencer | 62/256 |
| 3,371,503 | 3/1968 | Perez | 62/277 X |
| 3,996,763 | 12/1976 | Karashima | 62/256 |
| 4,120,174 | 10/1978 | Johnston | 62/256 |
| 4,308,726 | 1/1982 | Perez et al. | 62/256 X |
| 4,329,852 | 5/1982 | Ibrahim et al. | 62/256 |

*Primary Examiner*—William E. Tapolcai

*Attorney, Agent, or Firm*—LeBlanc, Nolan, Shur & Nies

[57] ABSTRACT

A refrigerated display case having an ambient air automatic defrost system and a method of operating such a case. The display case has an access opening in one wall for enabling products within the display section to be removed. The access opening can be either in the top of front wall of the display case. At least one air conduit extends in an approximately C-shaped formation around the display case. The air conduit has openings at both ends, with such openings being located on opposite sides of the access opening. Arranged within the air conduit is at least one reversible fan and a set of refrigeration coils. During a refrigeration cycle the fan circulates air through the air conduit in a first direction towards the refrigeration coils. When frost buildup within the display case has reached a certain level, the system is switched to a defrost cycle. During the defrost cycle, the fan circulates in the opposite direction through the air conduit and draws in ambient air from outside of the display case. Since such ambient air is of a higher temperature than the normally refrigerated air, it serves to defrost the system. The ambient air, after passing over the evaporator coils and through the air conduit, is expelled from the air conduit in a direction towards the outer side of the refrigerated case so as to move away from the interior of the case. An air flow control means is provided for accomplishing this purpose.

20 Claims, 7 Drawing Figures

REFRIGERATED DISPLAY CASE HAVING AMBIENT AIR DEFROST

RELATED APPLICATIONS

The present application is a continuation-in-part of my copending patent applications: Ser. No. 117,571 filed Feb. 1, 1980, which is, in turn, a continuation-in-part of patent application Ser. No. 60,459 filed July 25, 1979, now U.S. Pat. No. 4,295,340, which was a continuation-in-part of my patent application Ser. No. 11,804 filed in Feb. 14, 1979, now abandoned; and my copending patent application Ser. No. 295,542 filed Aug. 24, 1981. These prior applications are wholly incorporated by reference herein as though fully set forth.

BACKGROUND OF THE INVENTION

The present invention relates to single air conduit refrigerated display cases having an ambient air defrost system. Of primary concern are display cases having access openings in their front walls. Both within the specification and the claims of the present application, all references to refrigeration apparatus or refrigeration operations are intended to include cooling both at a temperature below 32° F., such as associated with frozen food display cases, and in excess of 32° F., such as typically associated with dairy food and fresh meat display cases.

Refrigerated display cases having either front and top access openings have been used for many years. Such open front cases are conventionally utilized for displaying dairy and meat products.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to switch from a refrigeration cycle to a defrost cycle of operation. By this manner of operation, it is possible to avoid any significant frost buildup with the display case.

Typically within the prior art, there have been three different approaches employed for defrosting refrigerated display cases. The first approach involves the use of electric resistance heaters that are arranged adjacent to the refrigeration coils of the refrigeration mechanism. During a defrost cycle, these heaters supply heat in an effort to melt the frost buildup on the coils and to supply warmer air for circulation with the case. This particular technique is relatively simple both in its construction and operation. However, since the electrical heaters are high voltage heaters that utilize significant electricity during operation, with the rapidly increasing cost of electricity it has become extremely uneconomical to employ such systems. Furthermore, the warm air circulated in the case can raise the temperature of the case too high. Thus, attempts have been made to find other alternatives to such a system.

A second type of system circulates hot compressed gaseous refrigerant through the refrigeration coils during the defrost cycle. During the defrost cycle, a valve control mechanism shuts off the supply of refrigerant to the refrigeration coils and alternatively feeds superheated compressed gaseous refrigerant through the coils. This hot gas serves to melt any frost buildup that has accumulated on the refrigeration coils but simultaneously provides heat within the air conduit which can be circulated through the display case, which again is disadvantageous. While this type of system does not suffer from the high cost of operation of the electrical heater defrost system, the heated gas system involves a relatively high construction cost. Due to the requirement that the system be able to selectively switch between the supply of heated gas and refrigerant to the refrigeration coils, a complicated flow system is required which increases the number of complex parts capable of breaking down and necessitating costly repairs.

The third type of system employed for defrosting display cases relies upon ambient air. It is this general category with which the invention of the present application is concerned. One type of system that employs ambient air during the defrost cycle is exemplified by those embodiments illustrated in U.S. Pat. Nos. 3,403,525; 3,850,003; and 3,937,033; all to Beckwith et al. Each of these systems uses fans separate from the main air circulating fans. These extra fans are turned on during the defrost cycle for pulling ambient air from outside of the display case into the air conduits. A second type of system is illustrated in U.S. Pat. No. 3,082,612 to Beckwith, which system draws ambient air into the main circulation path through ports located in the lower front panel of the refrigerated display case. Such ports are normally closed during the refrigeration cycle and are opened during the defrosting cycle. The Bechwith et al '003 patent indicates that the concepts described in U.S. Pat. Nos. 3,082,612 and 3,403,525 did not prove to be practical and hence were not commerically feasible.

A third type of ambient air defrosting system is shown in U.S. Pat. No. 4,144,720 to Subera et al, which is assigned to the same assignee as the present application. In the foregoing patent application, an open front refrigerated display case having primary and secondary air conduits is disclosed. In this system, reversible fans are employed for reversing the direction of flow of air within the conduits and simultaneously drawing in air from outside of the display case.

Another system employing reversible fans for ambient air defrost is shown in U.S. Pat. No. 4,026,121. This patent, however, refers to short-circulating the air flow between the primary and secondary air bands for the purpose of supplying warmer air to the primary band. No means for causing the defrost air to flow outwardly away from the display case is shown.

It has been recognized that an ambient air defrost operation can be incorporated into an open top refrigerated display case as disclosed in U.S. Pat. No. 4,120,174 to Johnston. The Johnston patent illustrates an open top case having a single air conduit extending around the case. During the refrigeration cycle, the air flows in a first direction and during the defrost cycle the direction of the air flow is reversed with ambient air being drawn into the conduit. The quantity of air flow during the defrost cycle is greater than during refrigeration. The defrost air, after passing through the conduit, is expelled in a direction up and over the refrigerated case. It has been found during the development of the present invention, that with a defrost air flow pattern such as disclosed in the Johnston patent a significant portion of the expelled air will fall back towards the access opening in the refrigerated case and reenter the air conduit at the other side of the access opening.

Similar to the open top display case of the above-identified patent to Johnston, there also are open front single air conduit cases which employ the same air defrost techniques as disclosed by the Johnston patent. During the defrost operation of such air defrost cases, the volume of the reverse air flow is relatively high and significantly greater than the air flow during the refrigeration cycle. Such a greater air flow is utilized so as to minimize the time needed for the defrost operation. As shown in FIG. 1, which illustrates this type of prior art display case, the higher air volume flow causes the warmer defrost air to reenter the display case which potentially can damage the products in the case. In addition the greater air flow causing the cold air to flow upwardly can result in hitting the customer in the face with such cold air.

Japanese Pat. No. 32,154 to Takizawa shows a refrigerated display cabinet in which a particular evaporator coil box suspension arrangement is shown in FIGS. 2–4. The English language abstract does not indicate an air defrost cycle and no air flow control means for use during air defrost to eject an air band away from the cabinet is set forth. The suspension arrangement may even prevent the use of air defrost.

SUMMARY OF THE INVENTION

An object of the present invention is to provide an improved ambient air defrost system within an open front refrigerated display case having at least one air conduit therein.

Another object of the present invention is to provide an energy efficient open front refrigerated display case employing an improved ambient air defrost system in which the ambient air is drawn into the air conduit by reversing the direction of flow of air through the conduit.

A further object of the present invention is to provide an open front refrigerated display case having a reversible fan arranged within an air conduit for propelling air in a forward direction through the refrigeration coils during a refrigeration cycle and circulating air in a reverse direction so as to draw in ambient air from outside of the case during a defrost cycle and to expel the defrost air from the conduit with an outwardly directed velocity vector such that it is effectively prevented from being drawn back into the refrigerated case.

A still further object of the present invention is to provide an improved procedure for defrosting an open front refrigerated display case by the use of ambient air.

These objectives are achieved by the utilization of a refrigerated display case with a front access opening that is constructed in accordance with the present invention. The display case is provided with an approximately C-shaped air conduit that extends around the display case and has openings at its opposite ends at opposite sides of the access opening of the display case. Arranged within the air conduit are the refrigeration coils and at least one reversible fan. In larger display cases, it is often necessary to use either two or three fans spaced along the longitudinal axis of the case in order to generate a sufficient force for circulating the air; in such a system, however, each fan preferable would be a reversible fan and operate in the same manner as disclosed herein in accordance with the present invention.

The reversible fan arranged within the C-shaped air conduit is capable of either circulating in a first direction towards the refrigeration coils during a refrigeration cycle or when the case is switched into a defrost cycle circulating the air in a second, opposite, direction. For the sake of convenience herein, the first direction shall be referred to as the forward direction and the second, opposite, direction as the reverse direction. The openings in the ends of the air conduit are aligned so that during the refrigeration cycle, refrigerated air leaves a first of the openings in a path towards the second opening so as to form an air curtain across the access opening in the display case. This air travelling across the access opening in the display enters the second opening in the air conduit and is drawn along the conduit back towards the fan thereby establishing a continuous refrigerated air band.

When the display case is switched into a defrost cycle, the refrigeration coils are deactivated and the direction of air flow is reversed. The defrost air is then expelled through the second conduit opening which has an air flow control means integrally formed therewith. The flow control means includes an air flow direction chamber positioned toward the outside direction of the central plane through the exit portion of the air conduit and an air grille which has an air ejector surface positioned with a plane normal to a portion thereof extending outwardly away from the display case. The flow direction chamber changes the velocity vector of the air band as it is expelled from the air conduit and the positioning of a portion of the ejector surface cooperates with the moving air band to maintain a significant horizontal velocity vector which is directed away from the central plane of the air conduit.

The volume of the air flow during defrost can be about 20% lower than the volume during refrigeration. During such reverse air flow, the air leaves the air conduit through the second opening. The air leaving the conduit is cooler than the ambient air since it has passed over the refrigeration coils for defrosting them; this expelled defrost air being somewhat cooled, therefore, is denser than the ambient air. The dense defrost air being propelled at a lower volume and hence slower speed will fall to the floor as it leaves the air conduit. Hence the defrost air will tend to fall away from the display case; i.e., towards the outside of the display case, thereby preventing portions of the defrost air from reentering the case and travelling across the access opening in the case and being drawn back into the air conduit. With such an air flow pattern, the defrost air also will not hit the customer in the face with cold air. This volumetric flow rate differential cooperates with the air flow control means including the air ejector surface of the air grille to help direct the defrost air flow away from the display case. Consequently, during the reverse flow of no air curtain is established and hence ambient air from outside of the case is drawn in through the first opening in the air conduit. Such ambient air being warmer than the refrigerated air serves to defrost the refrigeration coils.

It is advantageous to avoid having the defrost air flow reenter the display case and also reenter the air conduit. While the ambient air as it passes over the evaporator coils heats the coils and the air drops to the temperature of the refrigerated products. If the defrost air reenters the conduit then this will significantly slow down the defrost operation. In addition, if the defrost air contacts the products it will raise the temperature of the products. By causing the defrost air to fall away from the refrigerated case, the products are protected without detrimentally increasing the defrost time period.

As frost accumulates on the evaporator coils during the refrigeration cycle, the conduit becomes blocked. Hence when the defrost cycle is initiated the quantity of air flow will be substantially less than the air flow during the refrigeration cycle. As the defrost cycle continues and the frost is eliminated, the defrost air flow will rise back toward the level of the refrigeration air flow, although not surpassing it.

In order to eliminate the buildup of condensation and frost on the grille structures mounted at the openings at the ends of the air conduit, it may be desirable to provide some type of mechanism for generating heat in these areas. For this purpose, within each of the areas, tubes containing the liquid refrigerant used in the system can be provided. These tubes are connected to the line that carries the liquid refrigerant for the refrigeration coils. Since the liquid refrigerant is warmer than the refrigerated air, the tubes provide a limited quantity of heat within each of the openings. The quantity of heat, however, is sufficient to help eliminate the condensation and the resulting buildup of frost.

DESCRIPTION OF THE PREFERRED EMBODIMENTS

Figure 1:
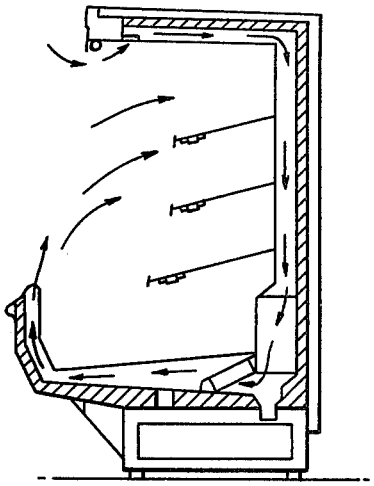
Fig.1 PRIOR ART
FIG. 1 is a diagrammatic sectional side elevational view of an open front refrigerated display case in accordance with the prior art, when the display case is operated during a defrost cycle with the air flow being relatively high.
Figure 2:
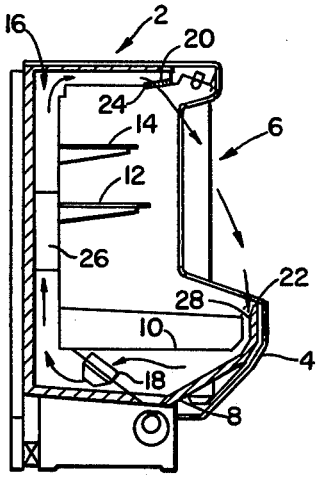
FIGS. 2 and 3 are diagrammatic sectional side elevational views of one embodiment of an open front refrigerated display case in accordance with the present invention, with FIG. 2 showing the air flow pattern during refrigeration and FIG. 3 showing the pattern during defrost.

An open front refrigerated display case 2 constructed in accordance with the present invention is illustrated in FIG. 2. The display case has top, bottom, rear and side walls along with a partial front wall. All of these outer walls are appropriately insulated. Front wall 4 has an access opening 6. Positioned above bottom wall 8 are a plurality of shelves 10, 12 and 14. The spacing between shelf 10 and bottom wall 8 is large enough to enable the fans and if desired the refrigeration coils, which are described later herein, to be arranged within that space. Extending along the top wall, rear wall and bottom wall is an air conduit 16. Arranged within air conduit 16 is at least one fan 18. While only one fan is illustrated, typically for refrigerated cases that are eight feet long, two fans are employed and for cases twelve feet long there are three fans. The number of fans merely depends on the length of the case and the size of the fans but have no bearing upon the scope of the present invention. All the fans arranged within air conduit 16 are reversible fans capable of being driven for propelling air in either direction.

Air conduit 16 has openings 20 and 22 at both of its ends at the top of the refrigerated display case. A directional control air grille 24 is mounted across opening 20. Grille 24 is preferable constructed so as to assist in directing air leaving air conduit 16 through opening 20 towards opening 22 on the opposite side of access opening 6 of the display case. At the opposite side of the display case across opening 22 there is integrally formed an air flow control means 28, shown in detail in FIG. 6, which has an air grille associated therewith. Air flow control means 28 is specially arranged and configured to control the air band direction emitted during defrost. In addition to helping in controlling the direction of flow of the defrost air band leaving opening 22, the air grille 28 also protects the opening from various debris, such as trash, keys and coins.

Refrigeration coils 26 are positioned within air conduit 16 at a location either adjacent to or above fan 18, such as shown in the figures. In a conventional manner, when the display case is operated in a refrigeration cycle, the air passing through refrigeration coil 26 is cooled, or refrigerated. The extent to which air is cooled depends on the use to which the display case is to be put. If the display case is to serve for holding frozen food, then the air must be sufficiently cooled so as to maintain the interior of the case below 32° F. If, however, the display case is used for storage of non-frozen products, such as dairy products, then a temperature slightly in excess of 32° F. can be maintained. The term refrigeration, however, as used herein is intended to cover both types of systems.

Figure 3:
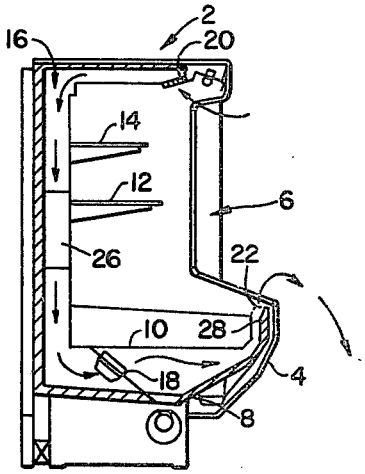

Turning now to the structural arrangement in the area of opening 22, as shown in FIGS. 2 and 3, the air flow control means 28 located in the top part of the lower portion of front wall 4 within air conduit opening 22 causes the defrost air to be directed towards the outside of display case 2. This air flow control means is detailed in the description of FIG. 6, below, and functions to direct air leaving conduit 16 through opening 22 during a defrost operation in a direction away from the display case as shown by the arrows in FIG. 3.

During the refrigeration cycle of operation of the display case, air is circulated through air conduit 16 by fan 18 in a forward direction towards and through refrigeration coils 26, which are activated for cooling. The volume of air flow during refrigeration is between 1000 and 1400 cfm. The air is cooled when passing through refrigeration coils 26. The cooled air then travels through the remaining portion of conduit 16. As the air reaches opening 20 in conduit 16, it is forced out through air louver grille 24 in a direction towards opening 22. In this manner, a curtain of cooled air is established across access opening 6 of the display case. The cooled air serves to refrigerate the products in the display case and also separate the warmer ambient air outside of the display case from the cooler air inside of the display case.

The air emitted through grille structure 24 and traveling across the access opening is received into opening 22 in the air conduit. This air is then drawn back into air conduit 16 by suction force established by fan 18. Thus, during the refrigeration cycle a continuous band of cooled air is circulated by fan 18 through the display case. The direction of travel of such air along the air band is illustrated in FIG. 2.

Turning now to the defrost cycle, the air flow during this cycle of operation is illustrated in FIG. 3. In any one of different conventional manners, the display case can be thermostatically or otherwise controlled so as to switch between the refrigeration cycle and the defrost cycle. By one such technique, the switching can occur when a certain degree of frost buildup is detected on the refrigeration coils. Another possible alternative is to switch the operation of the display case from a refrigeration cycle to a defrost cycle at set time intervals.

During the defrost cycle, the operation of fan 18 is reversed so as to propel air in a reverse direction away from refrigeration coils 26. When the fan is operated in this mode, air passes along conduit 16 out through opening 22. The air upon exiting from opening 22 is diffused and falls to the floor outside of the case. As the air leaving conduit 16 during the defrost cycle passes through the air flow control means 28, the path of air curves into an arc direction up and away from display case 2. Thus, in this mode of operation, there is not air curtain established across the access opening of display case 2 and also no continuous air band established through the display case. The volume of air flow during the defrost operation is between 800 and 1100 cfm and should be less than the air flow during refrigeration. If the air flow during defrost is increased to above 1600 cfm then a curtain of air will be established across access opening 6 during the defrost operation.

As air is propelled out of conduit 16 through opening 22, a partial vacuum is established within the air conduit so as to cause air to be sucked into the conduit through opening 20. Since there is no air curtain in existence across the top of the display case during the defrost cycle, the air sucked into the conduit through opening 20 is drawn from the ambient air surrounding the display case. Since such ambient air is of a higher temperature than the refirgerated air during the refrigeration cycle, such ambient air servies to defrost any frost buildup within the system, including, in particular, on the refrigeration coils. The direction of air flow during the defrost cycle is shown by the arrows in FIG. 3.

Figure 4:
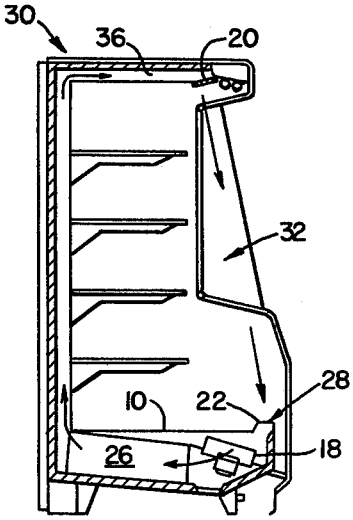
FIGS. 4 and 5 are diagrammatic views similar to FIGS. 2 and 3, respectively, of another embodiment of the present invention.
Figure 5:
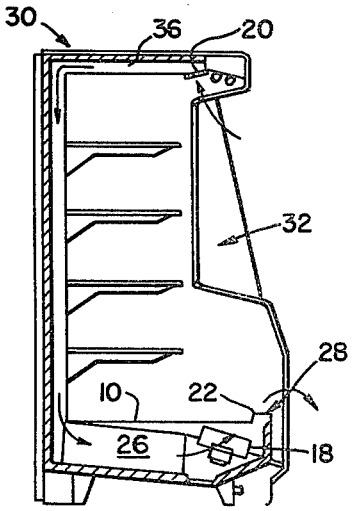

Another embodiment of the invention is shown in FIGS. 4 and 5. Display case 30 has an access opening 32 and an air conduit 36. Both display case 30 and display case 2 have air flow control means 28 mounted in the conduit openings 22; however, these are of slight different configuration as shown. Otherwise both display cases operate in substantially the same manner.

Figure 6:
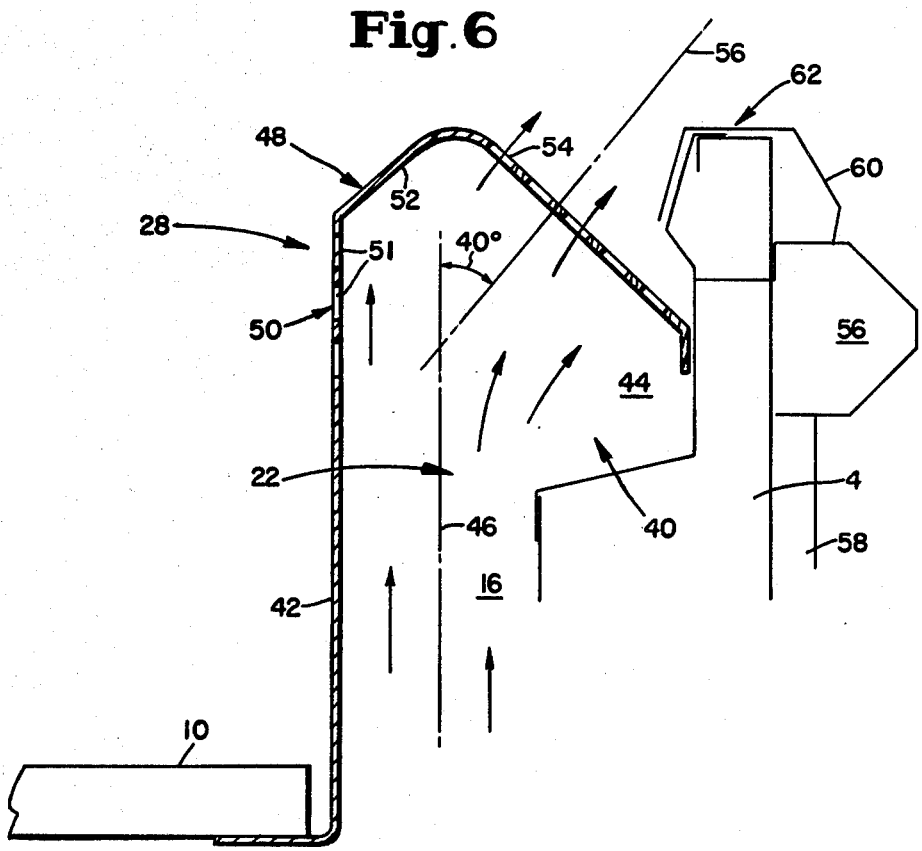
FIG. 6 is a detailed diagrammatic view of the flow control means and air grille structure of the present invention.

Referring now to FIG. 6, a detailed view of the conduit openings 22 of FIGS. 2–5 is shown with an air flow direction chamber 40 integrally formed in the upper portion of the air conduit 16. The configuration of this chamber 40 is that diagrammatically illustrated in preferred FIGS. 4 and 5 and thus differs slightly from the chamber shown broadly in FIGS. 2 and 3. The air conduit 16 is formed between front wall 4 and interior conduit wall 42. The configuration of chamber 40 is such that an enlarged air flow space 44 is positioned to the outward side of the central plane 46 which extends vertically within conduit 16.

An air grille 48 is positioned over air conduit opening 22 and the chamber 40 and is connected to the upper edge of interior conduit panel 42 by a first vertical section 50 having air flow apertures 51 therein for permitting throughflow during a refrigeration cycle. An upper arcuate non-perforated, solid section 52 is connected to the upper edge of vertical section 50 and extends outwardly toward front wall 4. A perforated air ejector surface 54 is connected between the non-perforated section 52 and the inner surface of front wall 4. The position and configuration of ejector surface 54 is such that a plane 56 normal or perpendicular to at least a portion thereof extends outwardly away from the display case 2 and forms an angle of at least about 20° with the vertical central plane 46 located in conduit 16. During the defrost cycle the defrost ambient air is forcibly ejected from conduit 16 by fan 18 and flows upwardly through opening 22. Due to the air flow direction chamber 40 the air direction is changed from the upward vertical flow path to an outward direction path which has, then, a significant horizontal velocity vector associated therewith. The flow direction is then roughly parallel to the plane 56 and the air is forced through air ejector surface 54 so that it flows upward and out of the display case 2. In this manner the ejector surface 54 cooperates with the defrost air band to maintain a significant horizontal velocity vector which is directed outwardly. The portion of the ejector surface which cooperates with the air band can be curvi-linear; however, a planer surface is preferred as shown in FIG. 6. Both surface configurations permit the outwardly direction position of plane 56.

Figure 7:
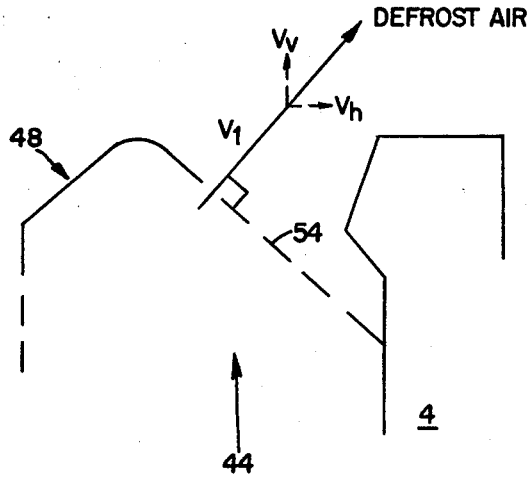
FIG. 7 is a vector diagram for the positioning of the air ejector surface of the air grille and the ejected defrost air band.

FIG. 7 shows a vector diagram for the resulting air flow path. The principal flow vector $V_1$ can be broken into the horizontal velocity component vector $V_h$ and the vertical vector $V_v$. The air flow control means formed by the conduit 16, opening 22, chamber 40, and air grille 48 is such that a significant horizontal velocity vector $V_h$ is imparted to the air band which then causes the air stream to be ejected by mass momentum through the ejector surface 54 outwardly away from the display case product storage space. The angle, $\theta$ formed by the complementary vertical vector $V_v$ is at least 20° as disclosed above.

Returning to FIG. 6, a bumper rail 56 can be attached to the outer surface of front wall 4 and trim members 58 and 60 can be arranged as well to form a decorated display case front wall. A lip arrangement 62 can also be formed over the top of the front wall which can vary slightly in its vertical position. The air flow apertures in air grille 48 can preferably be rectangular of 7/16 inch by ¾ inch sizes spaced in both directions on 1 inch centerlines, although circular or other shaped openings can also be used. A more highly perforated aperture pattern that this can be used for the ejector surface 54 if desired.

It will be noted that the arcuate non-perforated air grille section 52 substantially over lies the upper part of the conduit 16, whereas the perforated air ejector surface 54 over lies the air flow direction chamber 40.

During the defrost cycle the dominant air flow is through the apertures in the ejector surface 54 due to the interaction of the defrost air band with the flow direction chamber 40. A small "leakage" flow through the apertures of the first vertical section 50 can occur, but is controlled to a low level by the outwardly directed horizontal velocity vector, $V_h$, so that substantially all air leaving the conduit 16 flows away from the case 2 during substantially the entire defrost cycle. Also, products stored on shelf 10 will further reduce any "leakage" flow which might occur.

The air flow control means of the present invention can be applied to refrigerated cases with single air conduits or to multi-conduit cases in which defrost air is expelled from the inner refrigerated conduit during a defrost cycle. In the latter type of application the second opening of the inner conduit is modified by inclusion of the air flow control means.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. In a refrigerated display case having front, bottom, rear, top and side outer walls and having an access opening in said front wall for enabling removal of refrigerated products and a product storage space arranged contiguous to said access opening, said case comprising at least one air conduit positioned about said storage space and having first and second openings at opposite ends thereof formed between interior air conduit panels and said outer walls of said display case and each of said openings being located at one side of said access opening; refrigeration means located within said air conduit for refrigerating air therein; air circulating means arranged within said conduit for moving air within said conduit in a forward direction and ejecting air out of said first opening and into said second opening during a refrigeration cycle; the improvement comprising: air defrost means for reversing the flow direction of air within said air conduit to enable ambient air to be drawn in from outside of said display case through said first opening and to expel a defrost air band from said second opening during a defrost cycle and for switching the operation of said display case between a refrigeration cycle and a defrost cycle; and air flow control means for causing substantially all air leaving said air conduit during substantially the entire defrost cycle to flow away from said case when such air is flowing in said reverse direction so that such air is prevented from reentering said air conduit, said air flow control means comprising an air flow direction chamber integrally formed with said second opening and positioned toward the outside of said display case from the central plane of said air conduit, said air flow direction chamber enabling the air band being ejected out of said second opening to change flow direction whereby a significant horizontal velocity vector directed away from the central plane of said air conduit is imparted to the ejected defrost air band, and an air grille positioned over said air conduit and said direction chamber, said air grille having a perforated air ejector planar surface integrally formed therein and positioned over said air flow direction chamber such that a perpendicular plane passing through said planar surface has an angle of at least 20° with a vertical plane passing through the center of said second opening and extending outwardly away from said vertical plane.

2. The improvement according to claim 1 wherein said first opening of said air conduit serves as an air outlet during a refrigeration cycle and said second opening serves as a return air inlet during a refrigeration cycle, said first and second openings being aligned so that at least a substantial portion of air leaving said first opening during a refrigeration cycle is received within said second opening thereby enabling a continuous refrigerated air band to be established within said case during a refrigeration cycle.

3. The improvement according to claim 1, wherein: during a defrost cycle, said air circulating means serves to draw in ambient air surrounding said case into said air conduit through said first opening and to expel defrost air from said second opening.

4. The improvement according to claim 1 or 2 further comprising means for providing heat within said air conduit in the area of said second opening during a refrigeration cycle so as to limit the amount of condensation and frost buildup within the area of said second opening during such refrigeration cycle.

5. The improvement according to claim 4 wherein said means for providing heat includes a plurality of tubes containing a liquid having a higher temperature than the air entering said second opening during a refrigeration cycle.

6. The improvement according to claim 5 further comprising further heating means for providing heat within said air conduit in the area of said first opening during a refrigeration cycle so as to limit the amount of condensation and frost buildup within the area of said first opening during such refrigeration cycle.

7. The improvement according to claim 6 wherein said further heating means includes a plurality of further tubes containing a liquid having a higher temperature than the air leaving said first opening during a refrigeration cycle.

8. The improvement according to claim 7 wherein said liquid in all of said liquid containing tubes is liquid refrigerant that is also circulated through said refrigerating means.

9. The improvement according to claim 1 wherein said air circulating means circulates an air flow volume during the defrost cycle which is lower than the air flow volume during a refrigeration cycle, and wherein said air circulation means and said air flow control means cooperate with one another to prevent such air from reentering said case during substantially the entire defrost cycle.

10. A refrigerated display case for the storage of products having front, bottom, rear, top and side outer walls and having an access opening in said front wall for enabling removal of refrigerated products and a product storage space arranged contiguous to said access opening, said display case being selectively operative in a refrigeration cycle and a defrost cycle, said case comprising: at least one air conduit positioned about said storage space, said air conduit having first and second openings at the opposite ends thereof formed between interior air conduit panels and said outer walls and each of said openings being located at one side of said access opening; means for refrigerating air moving through said conduit during a refrigeration cycle, said means for refrigerating being arranged within said air conduit; air circulating means arranged within said air conduit, said air circulating means propelling air within said air conduit in a forward direction during a refrigeration cycle; air defrost means for reversing the flow direction of air within said air conduit to enable ambient air to be drawn in from outside of said display case through said first opening and to expel a defrost air band from said second opening during a defrost cycle and for switching the operation of said display case between a refrigeration cycle and a defrost cycle; and air flow control means for causing substantially all air leaving said air conduit during substantially the entire defrost cycle to flow away from said case when such air is flowing in said reverse direction so that such air is prevented from reentering said air conduit; said air flow control means comprising an air flow direction chamber integrally formed with said second opening and positioned toward the outside of said display case from the central plane of said air conduit, said air flow direction chamber enabling the air band being ejected out of said second opening to change flow direction whereby a significant horizontal velocity vector directed away from the central plane of said air conduit is imparted to the ejected defrost air band, an air grille positioned over said air conduit and said direction chamber and having an air ejector surface integrally positioned over said air flow direction chamber such that a perpendicular plane passing through said ejector surface has an outwardly directed angle of at least 20° with a vertical plane passing through the center of said second opening.

11. The display case according to claim 10 wherein said first opening of said air conduit serves as an air outlet during a refrigeration cycle and said second opening serves as a return air inlet during a refrigeration cycle, said first and second openings being aligned so that at least a substantial portion of air leaving said first opening during a refrigeration cycle is received within said second opening thereby enabling a continuous refrigerated air band to be established within said case during a refrigeration cycle.

12. The display case according to claim 11 wherein during a defrost cycle, said air circulating means serves to draw in ambient air surrounding said case into said air conduit through said first opening and to expel defrost air from said second opening.

13. The display case according to claim 10 or 11 further comprising means for providing heat within said air conduit in the area of said second opening during a refrigeration cycle so as to limit the amount of condensation and frost buildup within the area of said second opening during such refrigeration cycle.

14. The display case according to claim 13 wherein said means for providing heat includes a plurality of tubes containing a liquid having a higher temperature than the air entering said second opening during a refrigeration cycle.

15. The display case according to claim 14 further comprising further heating means for providing heat within said air conduit in the area of said first opening during a refrigeration cycle so as to limit the amount of condensation and frost buildup within the area of said first opening during such refrigeration cycle.

16. The display case according to claim 15 wherein said further heating means includes a plurality of further tubes containing a liquid having a higher temperature than the air leaving said first opening during a refrigeration cycle.

17. The display case according to claim 16 wherein said liquid in all of said liquid containing tubes is liquid refrigerant that is also circulated through said refrigerating means.

18. The display case according to claim 10 wherein said air circulating means circulates an air flow volume during the defrost cycle which is lower than the air flow volume during a refrigeration cycle, and wherein said air circulation means and said air flow control means cooperate with one another to prevent such air from reentering said case during substantially the entire defrost cycle.

19. In a refrigerated display case having front, bottom, rear, top and side outer walls and having an access opening in said front wall for enabling removal of refrigerated products and a product storage space arranged contiguous to said access opening, said case comprising at least one air conduit positioned about said storage space and having first and second openings at opposite ends thereof formed between interior air conduit panels and said outer walls of said display case and each of said openings being located at one side of said access opening; refrigeration means located within said air conduit for refrigerating air therein; air circulating means arranged within said conduit for moving air within said conduit in a forward direction and ejecting air out of said first opening and into said second opening during a refrigeration cycle; the improvement comprising: air defrost means for reversing the flow direction of air within said air conduit to enable ambient air to be drawn in from outside of said display case through said first opening and to expel a defrost air band from said second opening during a defrost cycle and for switching the operation of said display case between a refrigeration cycle and a defrost cycle; and air flow control means for causing substantially all air leaving said air conduit during substantially the entire defrost cycle to flow away from said case when such air is flowing in said reverse direction so that such air is prevented from reentering said air conduit, said air flow control means comprising an air flow direction chamber integrally formed with said second opening and positioned toward the outside of said display case from the central plane of said air conduit, said air flow direction chamber enabling the air band being ejected out of said second opening to change flow direction whereby a significant horizontal velocity vector directed away from the central plane of said air conduit is imparted to the ejected defrost air band, an air grille positioned over said air conduit and said direction chamber, said air grille having a perforated air ejection planar surface integrally formed therein and positioned over said air flow direction chamber such that an intersecting perpendicular plane has an angle of at least 20° with a vertical plane passing through the center of said second opening, said air grille comprising an interior wall segment connected to said interior conduit panel, a non-perforated air restrictor section interconnected between the upper portion of said interior wall segment and said air ejector surface, and said air ejector surface being positioned over said air flow direction chamber and said air restrictor section being positioned over a substantial portion of said air conduit.

20. A refrigerated display case for the storage of products having front, bottom, rear, top and side outer walls and having an access opening in said front wall for enabling removal of refrigerated products and a product storage space arranged contiguous to said access opening, said display case being selectively operative in a refrigeration cycle and a defrost cycle, said case comprising: at least one air conduit positioned about said storage space, said air conduit having first and second openings at the opposite ends thereof formed between interior air conduit panels and said outer walls and each of said openings being located at one side of said access opening; means for refrigerating air moving through said conduit during a refrigeration cycle, said means for refrigerating being arranged within said air conduit; air circulating means arranged within said air conduit, said air circulating means propelling air within said air conduit in a forward direction during a refrigeration cycle; air defrost means for reversing the flow direction of air within said air conduit to enable ambient air to be drawn in from outside of said display case through said first opening and to expel a defrost air band from said second opening during a defrost cycle and for switching the operation of said display case between a refrigeration cycle and a defrost cycle; and air flow control means for causing substantially all air leaving said air conduit during substantially the entire defrost cycle to flow away from said case when such air is flowing in said reverse direction so that such air is prevented from reentering said air conduit; said air flow control means comprising an air flow direction chamber integrally formed with said second opening and positioned toward the outside of said display case from the central plane of said air conduit, said air flow direction chamber enabling the air band being ejected out of said second opening to change flow direction whereby a significant horizontal velocity vector directed away from the central plane of said air conduit is imparted to the ejected defrost air band, an air grille positioned over said air conduit and said direction chamber and having an air ejector surface integrally positioned over said air flow direction chamber such that an intersecting perpendicular plane through a portion thereof has an outwardly directed angle of at least 20° with a vertical plane passing through the center of said second opening, said air grille comprising an interior wall segment connected to said interior conduit panel, a non-perforated air restrictor section interconnected between the upper portion of said interior wall segment and said air ejector surface, and said air ejector surface being positioned over said air flow direction chamber and said air restrictor section being positioned over a substantial portion of said air conduit.

* * * * *